US006359588B1

(12) United States Patent
Kuntzsch

(10) Patent No.: US 6,359,588 B1
(45) Date of Patent: Mar. 19, 2002

(54) PATCH ANTENNA

(75) Inventor: Tilmann Kuntzsch, Ulm (DE)

(73) Assignee: Nortel Networks Limited, St. Laurent (CA)

( * ) Notice: Subject to any disclaimer, the term of this patent is extended or adjusted under 35 U.S.C. 154(b) by 0 days.

(21) Appl. No.: 08/893,428

(22) Filed: Jul. 11, 1997

(51) Int. Cl.[7] ..... H01Q 1/38
(52) U.S. Cl. ..... 343/700 MS; 343/846
(58) Field of Search ..... 343/700 MS, 829, 343/841, 846, 848; H01Q 1/38

(56) References Cited

U.S. PATENT DOCUMENTS

| | | | | | |
|---|---|---|---|---|---|
| 4,320,402 | A | * | 3/1982 | Bowen | 343/700 MS |
| 5,001,493 | A | * | 3/1991 | Patin et al. | 343/700 MS |
| 5,014,070 | A | * | 5/1991 | Stock et al. | 343/700 MS |
| 5,075,691 | A | * | 12/1991 | Garay et al. | 343/700 MS |
| 5,165,109 | A | * | 11/1992 | Han et al. | 343/700 MS |
| 5,181,025 | A | * | 1/1993 | Ferguson et al. | 343/700 MS |
| 5,287,116 | A | * | 2/1994 | Iwasaki et al. | 343/700 MS |
| 5,416,490 | A | * | 5/1995 | Popovic | 343/700 MS |
| 5,635,942 | A | * | 6/1997 | Kushihi et al. | 343/700 MS |
| 5,861,848 | A | * | 1/1999 | Iwasaki | 343/700 MS |
| 5,995,047 | A | * | 11/1999 | Freysinier et al. | 343/700 MS |

FOREIGN PATENT DOCUMENTS

GB 2281661 A 3/1995

OTHER PUBLICATIONS

Microstrip Antenna Feeds by R P Owens, pp. 815–825.

* cited by examiner

*Primary Examiner*—Tan Ho
(74) *Attorney, Agent, or Firm*—John D. Crane

(57) ABSTRACT

The present invention relates to patch antennas and in particular relates to a feed mechanism therefor. In accordance with one aspect of the invention, there is provided a patch antenna comprising a dielectric substrate having a patch element on a first side and a microstrip feed therefor on a second side and a reflector ground plane; wherein the microstrip feed is connected through the dielectric to the patch whereby the microstrip feed is parallel spaced apart from the patch and from a shielding grounded portion. The patches can be rectilinear or ellipsoidal, and can have one or more feeds. An impedance matching network can be disposed on the antenna dielectric. Preferably, this network is positioned on an opposite side of the dielectric to the patch and shielded by the ground plane. This type of feed arrangement can provide an optimum feed point location for any polarisation. In dual polarised mode, there is no compromise in either cross polar performance nor impedance matching to be performed. No edge interference is produced. A method of operation is also disclosed

8 Claims, 11 Drawing Sheets

PATCH ANTENNA

FIELD OF THE INVENTION

The present invention relates to patch antennas and in particular relates to a feed for a patch antenna.

BACKGROUND OF THE INVENTION

Patch antennas comprise one or more conductive rectilinear or ellipsoidal patches supported relative to a ground plane and radiate in a direction substantially perpendicular to the ground plane. Conveniently patch antennas are formed employing microstrip techniques; a dielectric can have a patch printed upon it in a similar fashion to the printing of feed probes employed in layered antennas.

The feed network will, in general, have certain characteristics which must be carefully monitored in order to minimise any adverse effects on the antenna performance. Printed or lumped elements, such as tapered lines or junctions will introduce electrical and physical discontinuities into a feed line. Attenuation due to conductor loss and dielectric loss will reduce the efficiency, and hence the gain, of an antenna. In practice it is rarely possible to eliminate the electrical effects completely by normal matching techniques, resulting in reflection losses, surface-wave loss and spurious radiation. The latter will, in general, be uncontrolled, and is likely to increase co-polar sidelobe levels in some directions, and to increase the total energy in the cross-polar radiation pattern, thereby reducing the antenna gain.

Direct radiation losses and surface-wave losses are eliminated in enclosed triplate and suspended stripline feeds, but any discontinuity causing asymmetry in the cross-section, such as a probe feed to a patch, will introduce losses due to the transfer of energy to a parallel-plate mode propagating between the ground planes. This energy is free to couple to adjacent probes, and may thus ultimately results in spurious radiation. The mode can be strongly attenuated by the use of mode-suppressing pins close to the discontinuity, or by means of microwave-absorbent film or sheet material, but this increases the complexity of the construction.

Coupling to a microstrip patch may be achieved by a variety of means: direct coupling of a microstrip line, gap-coupling and proximity coupling to a microstrip line and probe coupling, for example.

In the case of direct feed line coupling, the feed line is directly coupled to the patch, critical coupling at the resonant frequency may be achieved by one of the three configurations shown in FIGS. 1, 2 and 3. FIG. 1 shows a feed line 2 and a rectangular patch 4, the patch being fed via a quarter-wave transformer (matching section) 6 having a particular impedance from the feed line. FIG. 2 shows an inset feed arrangement 8 which shifts the feed point of a feed line 10 to a lower impedance region inside the patch 12. For some applications, such as dual polarised applications, this cannot be used because of interference caused by the inset area on the patch, because of a cross polar requirement and the patch edges need to be protected. Equivalent circuits are show for these feed arrangements. The feed line 14 can enter at a point about one third of the way along a non-radiating edge of a patch 16, as shown in FIG. 3. Shorter feed lines with lower loss may be possible using this configuration in a corporate feed network, though an aspect ratio of about 1.5 is required to minimise cross polar radiation. Furthermore the microstrip feedline is exposed and also contributes to spurious radiative effects. A dual polarisation capability will also be difficult to achieve for the patches shown in FIGS. 2 and 3, whilst track losses and layout size are problems for the antenna shown in FIG. 1.

Gap and proximity coupling schemes both utilise a narrow gap between a feed line and a resonant patch, FIGS. 4 and 5 show gap 18 and proximity 20 coupling feeds. The width of the gap dictates the strength of the coupling at the resonant frequency. When the feed line and the resonant patch are critically coupled, the latter constitutes a matched termination. Proximity Coupling is a method used for coupling a single feed line to a linear array of resonant patches and is similar to gap feed coupling. In an array configuration, the individual patches do not necessarily need to be matched to the feed line, neither do they have to operate at maximum efficiency. Coupling gaps can be varied to control the proportion of power coupled into the patches, and the patches themselves can have characteristic impedances rather higher than those normally associated with more conventional low-impedance patches.

Probe coupling has been widely employed, particularly for circular patches, an example of which is shown in FIG. 6. The feed 22 lies behind the radiating patch 24 which is supported on a dielectric substrate 26 which has a ground plane 28 on its anterior surface and therefore does not itself contribute any unwanted radiation. On the debit side, the termination does not lead to a compact configuration, with the antenna plus, typically, a coaxial connector exhibiting additional depth and bulk. A pin 30 projects from the connector and is typically soldered to the patch. The feed network must lie in a separate layer behind the radiating surface, so the complete antenna cannot be etched on a single substrate.

For modern telecommunications applications, apart from the electrical performance of the antenna other factors need to be taken into account, such as size, weight, cost and ease of construction of the antenna. Depending on the requirements, an antenna can be either a single radiating element or an array of like radiating elements. With the increasing deployment of cellular radio, an increasing number of base stations which communicate with mobile handsets are required. Similarly an increasing number of antennas are required for the deployment of fixed radio access systems, both at the subscribers premises and base stations. Such antennas are required to be both inexpensive and easy to produce. A further requirement is that the antenna structures be of light weight yet of sufficient strength to be placed on the top of support poles, rooftops and similar places and maintain long term performance over environmental extremes.

Typical subscriber antennas for fixed wireless access installations employing patch antennas have microstrip feed cut-ins to find the optimum feed point. Patches having such cut-ins, however, do not necessarily provide good cross polar performance. Also the patch cannot be widened for increased bandwidth, since it needs to be symmetrical, regarding the need for two polarisations. It is therefore very important to minimise parasitic effects of the feed while maintaining simple manufacturability.

OBJECT OF THE INVENTION

The present invention seeks to provide a patch antenna and a feed network therefor. The present invention further seeks to provide a patch antenna of reduced Z-axis dimensions and which can achieve dual polarisation capability and can be matched for a maximum of bandwidth.

STATEMENT OF THE INVENTION

In accordance with a first aspect of the invention, there is provided a patch antenna comprising a dielectric substrate having a patch element on a first side in connection with a microstrip feed therefor on a second side of the substrate and a reflector ground plane; wherein the microstrip feed line is connected through the substrate to the patch, whereby the microstrip feed line lies parallel to the patch, with the patch acting as a ground with respect to the microstrip line.

No edge interference is produced due to the coupling of a microstrip line to a surface contact point of the patch. The patches can be rectilinear or ellipsoidal, and can have one or more feeds. Preferably the shielding ground is disposed on the surface of the dielectric which supports the patch element. The patch and ground plane thereby screen the microstrip feed line and distribution network, for any polarisation. This type of feed arrangement can provide an optimum feed point location for any polarisation. In dual polarised mode, there is no compromise in either cross polar performance nor impedance matching.

A matching network can be disposed on the antenna dielectric. Preferably, this network is positioned on an opposite side of the dielectric to and shielded by the ground plane. By the use of microstrip printing techniques a patch antenna can be simply and cost effectively manufactured; fewer process steps are involved in production and microstrip techniques are well developed. The matching network can be formed with discrete components.

In accordance with another aspect of the invention there is provided a method of operating of a patch antenna comprising a patch element, a dielectric substrate, a ground plane and a feed network, the patch antenna element comprising a patch element, a dielectric substrate, a ground plane and a feed network; wherein the patch is supported on a first side of the dielectric substrate and transmits and receives signals via a feed line positioned on the other side of the board opposite the patch element, whereby the signals are transmitted in a microstrip transmission mode.

DESCRIPTION OF THE DRAWINGS

In order that the present invention can be more fully understood and to show how the same may be carried into effect, reference shall now be made, by way of example only, to the Figures as shown in the accompanying drawing sheets wherein:

FIG. 9 shows a plan view of a second embodiment of the invention;

FIGS. 10 and 11 show cross-sectional views of X—X and Y—Y in FIG. 9;

FIG. 12 shows a plan and sectional views of a third embodiment of the invention.

DETAILED DESCRIPTION OF THE PREFERRED EMBODIMENTS

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific.

Figure 1:
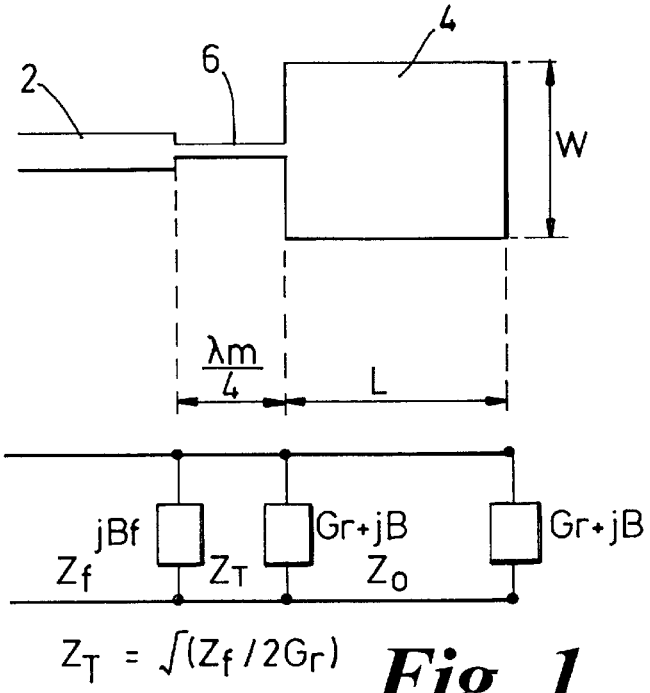
Fig. 1 Prior Art
FIG. 1 shows a direct coupled patch antenna.
Figure 2:
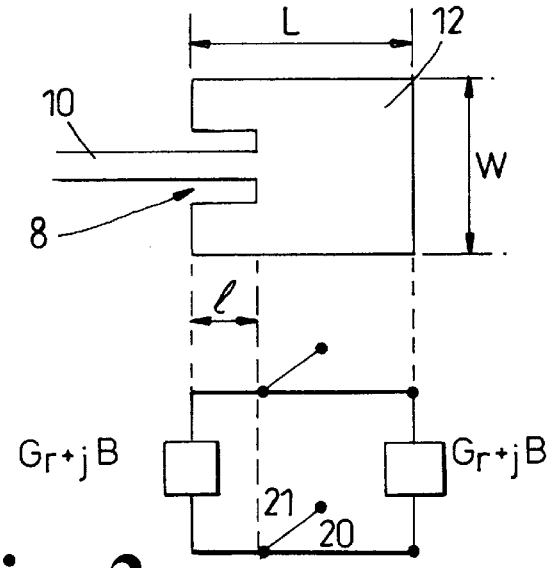
Fig. 2 Prior Art
FIG. 2 shows a second type of direct coupled patch antenna.
Figure 3:
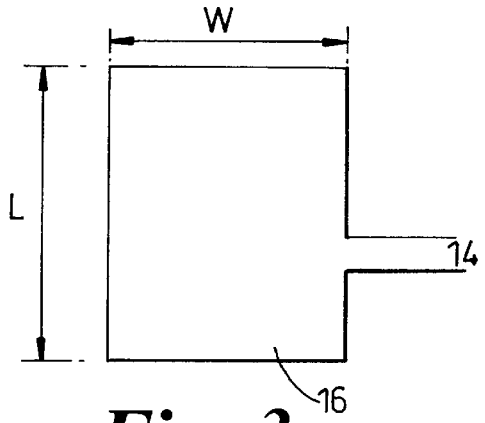
Fig. 3 Prior Art
FIG. 3 shows a third type of direct coupled patch antenna.
Figure 4:
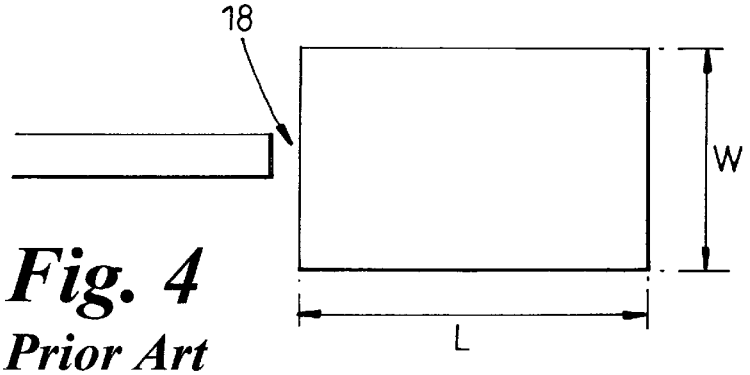
Fig. 4 Prior Art
FIGS. 4 and 5 show gap and proximity coupled antennas respectively.
Figure 5:
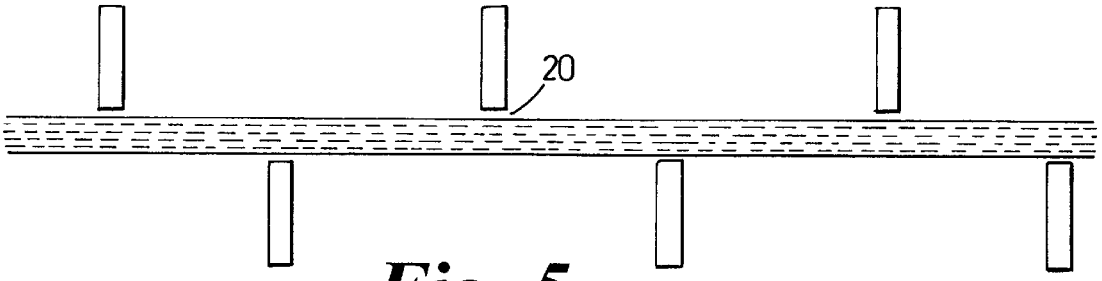
Fig. 5 Prior Art
Figure 6:
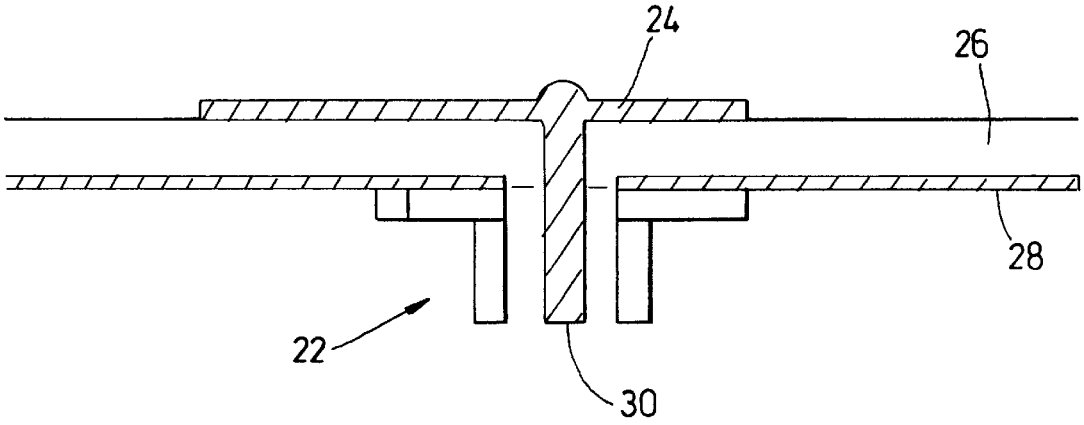
Fig. 6 Prior Art
FIG. 6 shows a probe feed patch antenna.
Figure 7:
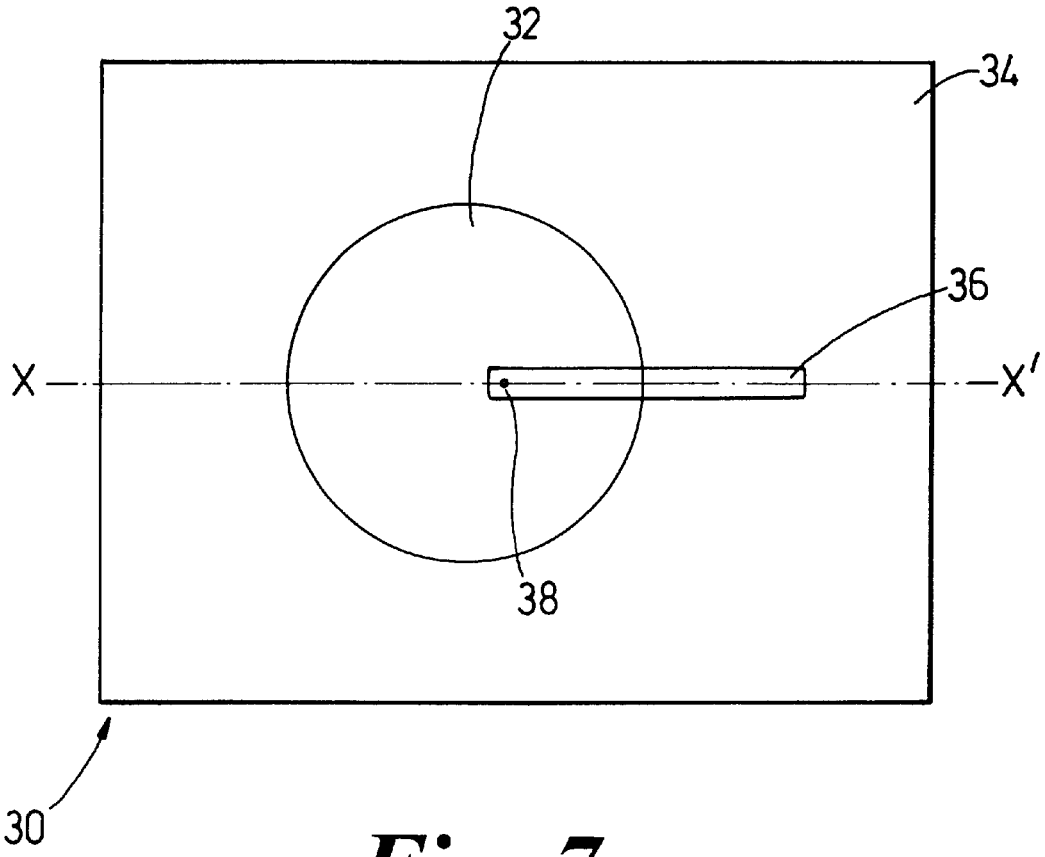
FIGS. 7 and 8 show plan and cross-sectional views of a first embodiment of the invention.
Figure 8:
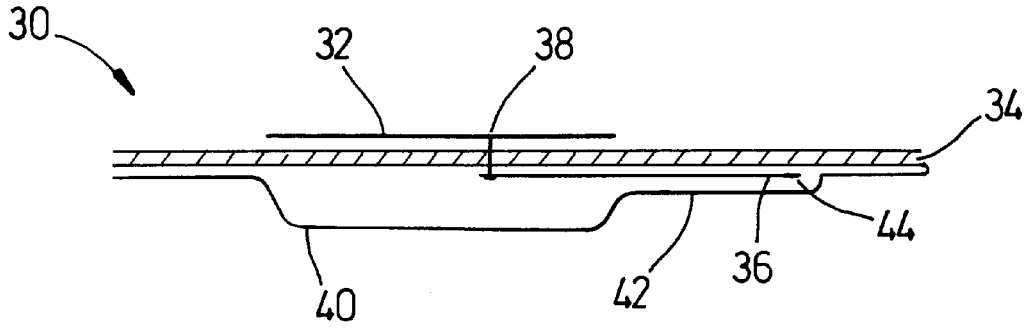

Referring now to FIGS. 7 and 8, there is shown a plan view and a cross-sectional view (through X–X' of FIG. 7) of a first embodiment made in accordance with the invention. The patch antenna 30 comprises a patch 32, supported on a first side of a dielectric 34. A microstrip feed 36 is printed on the other side of the dielectric and is in contact with the patch by means of a plated via 38 or similar. The patch is preferably placed a distance from a reflective ground plane 40, as is shown. Signals are fed to the patch by the microwave feed line 36 in a microstrip mode of transmission, with the patch 32 acting as a ground with respect to the microstrip line, when the microstrip line is opposite the patch. Microstrip line 36 is prevented from radiating and causing interference when not opposite the patch by shielding ground means 42, which is a shaped part of reflector plane 40. The microstrip line is fed from a cable and the microstrip line will be of a form such that it provides a suitable matching circuit between the cable and the patch, with regard to, inter alia, the dielectric constant of the board and the radome spacing. Typically the cable is a semi-rigid coaxial cable and is soldered to a via hole where contact is made with the microstrip metal, which is typically a copper alloy. For a 150 mm diameter patch, the cavity under the patch, in the grounded reflective back plane, would be approximately 160 mm, with the spacing between the patch and back plane being around 30 mm.

Figure 9:
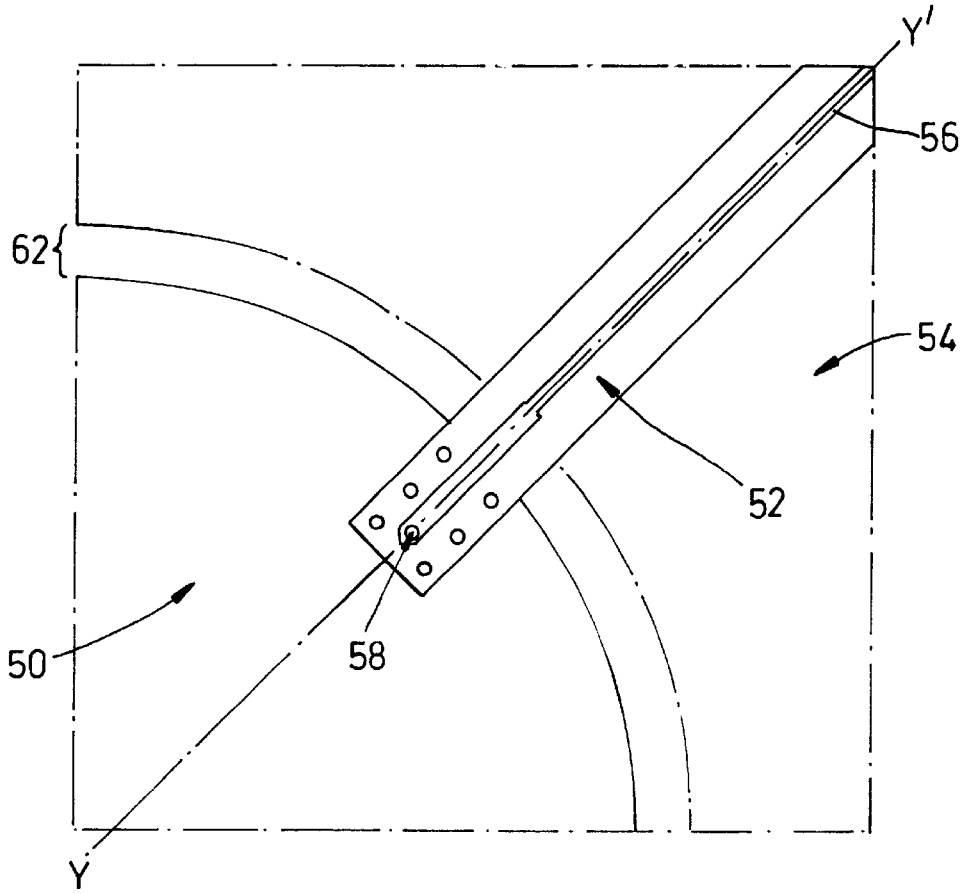
FIGS. 9 and 10 show plan and cross-sectional views of a second embodiment of the invention.
Figure 10:
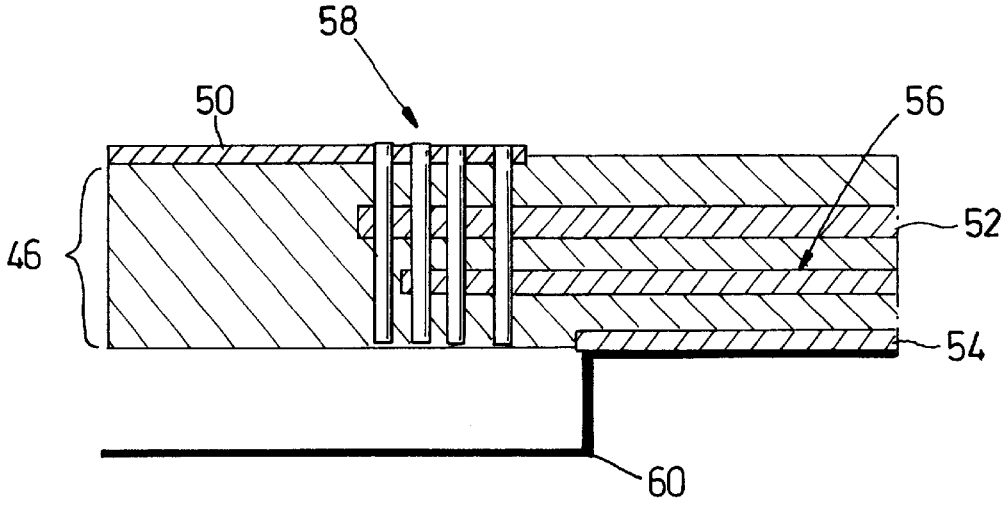

FIGS. 9 and 10 show a quadrant of a second embodiment in plan and cross-sectional views (through Y–Y' of FIG. 9). The dielectric 48 is a four-layer board, having a patch antenna 50 on a first (upper) layer, ground planes 52, 54 in the areas outside the patch, on the fourth and second layers and a micro/stripline (buried layer) 56 screened and thus non-radiating between the two ground planes, protected from the radome effects and the environment. Vias 58 provide a feed and mode suppression means for the feed between the microstrip line and the patch. A reflecting back plane 60 is provided, which is connected to ground by direct contact to the lower ground plane. A boundary 62 can be defined between the patch and the ground plane.

Figure 11:
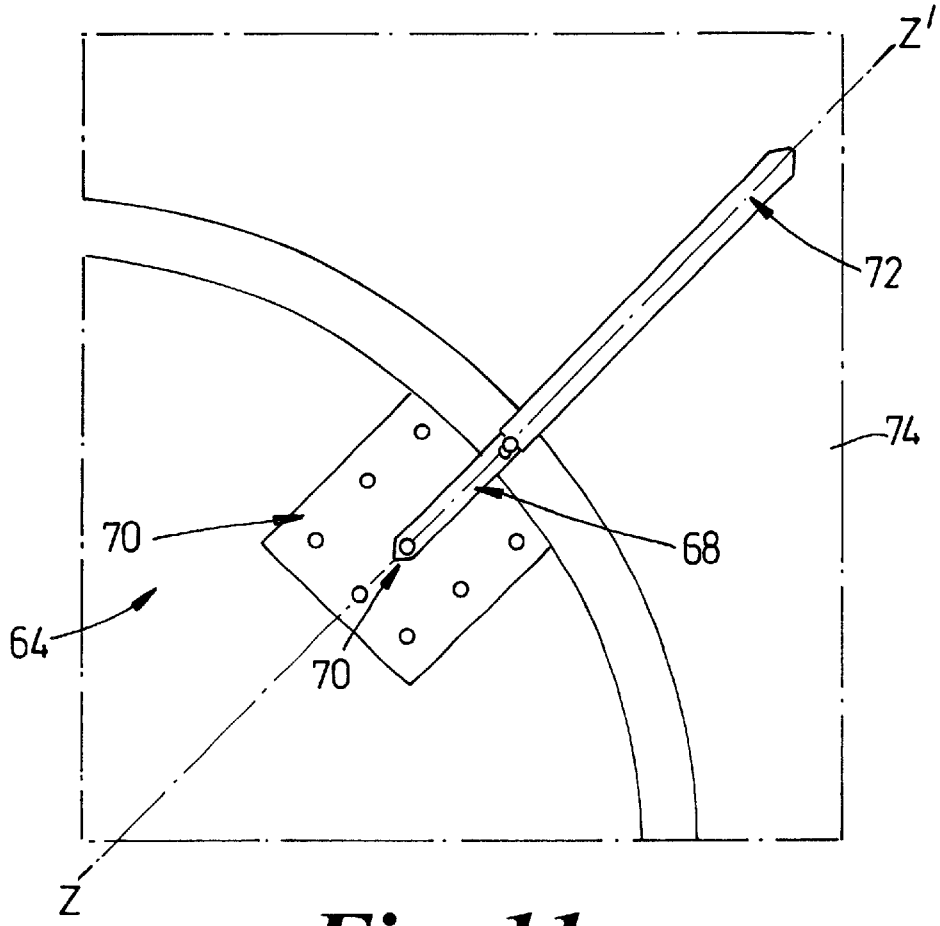
FIGS. 11 and 12 show plan and cross-sectional views of a third embodiment of the invention.
Figure 12:
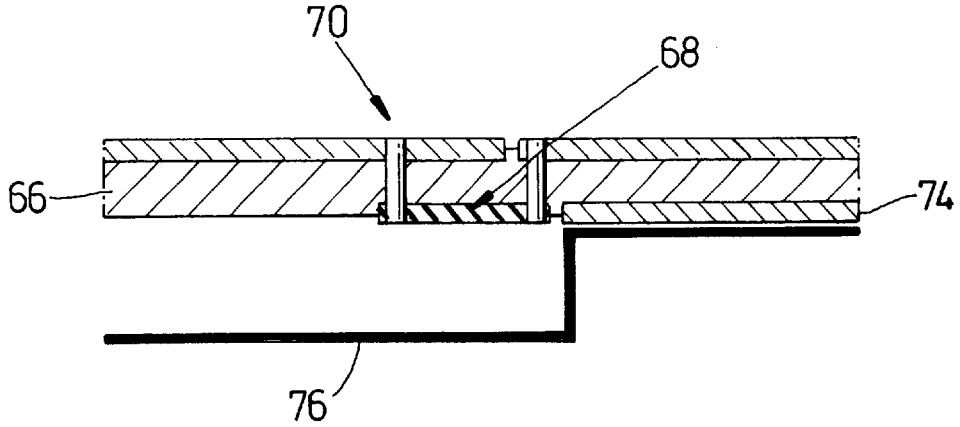

FIGS. 11 and 12 show a still further embodiment, again in plan and cross-sectional views (the cross-section being through Z–Z' in FIG. 11). In this embodiment, which includes a circular patch 64 printed upon a single dielectric 66, the microstrip feed 68 continues only for a short distance on the opposite side of the dielectric relative to the patch. Vias 70 are provided to transfer the microwave signals from an input microstrip line 72 to the underside feed microstrip line 68. For convenience the upper microstrip to lower microstrip transition is made in the region between the ground plane 74. Again, a reflector plane 76 is also present. Ground plane 74 is provided to ensure microstrip transmission mode for microstrip line 72. A further ground plane portion to shield the microstrip line fields above the dielectric may be appropriate.

The patches can be printed by standard techniques onto the dielectric. The patch and the feed network can be manufactured in one process. The distance of the patches to a ground plane is a compromise between bandwidth and space constraints. For certain applications, where a low profile antenna is required, patch antennas provide a good bandwidth.

In order to provide a suitable matching network without incurring too much loss, a design having a spacing below the patch with respect to the reflector ground plane was set at 13 mm, for the 900 MHz GSM band, by conforming the antenna element and the heat sink units behind it with a protective radome. This depth may be varied for other frequencies such as the 1800 and 1900 MHz bands.

Dual polarisation can be employed to provide one form of diversity. This can be implemented using two polarisations at ±45°. On the receive side, polarisation diversity using techniques such as maximal ratio combining techniques (other types of combining are possible) helps to overcome propagation fading.

Pattern broadening can be employed by feeding a second azimuth element in anti-phase and at reduced amplitude. If two patches are employed, then they should be positioned closely adjacent each other to prevent too big a dip on broadside of the azimuth pattern. For one embodiment, a separation distance of about 0.7 $\lambda$ was chosen, which provided a 100° beamwidth with a 3 dB dip.

Figure 13:
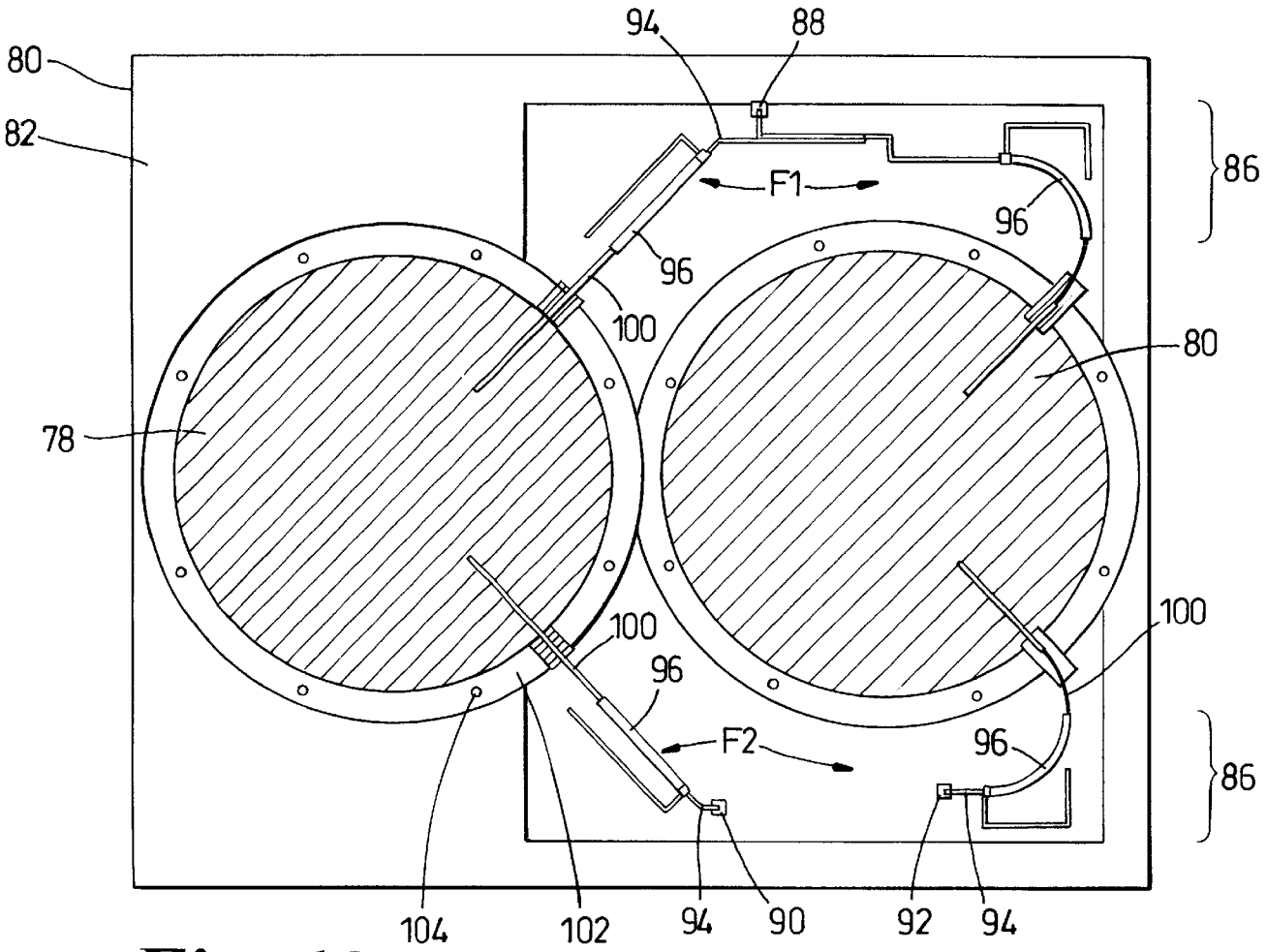
FIG. 13 shows a fourth type of antenna.

For a fourth embodiment, as shown in FIG. 13, given the above constraints, two circular patches were chosen to reserve room for a distribution network, especially since square patches at ±45° would touch at their edges. The antennas are operable in both transmission and reception at two orthogonal polarisations and exhibit a suitable antenna pattern. FIG. 13 shows the patches 78, 80 and ground plane 82 on a first side of a dielectric substrate 84 and microstrip lines/feed network 86 on a second side of the dielectric. For reasons of convenience, FIG. 13 shows two types of microstrip feed lines for the patches. A first type of feed F1 provides the connection to the patches of a first polarisation and two separate feeds F2 provide the connection to the patches for the other polarisation. The feeds F2 can be fed independently, which is not the case for feeds F1. Solder pads 88, 90, 92 provide contact points to receive input signals from, for example, a coaxial cable. The microstrip arms 94 have a first width, a second width 96 for matching purposes, and a third width 100 as they pass under the patches 78, 80. In the figure, the periphery of the patches have a plated annular region 102 on the side opposite to the patches with positions 104 indicated for the placement of fastening screws, or the like, whereby the dielectric may be securely fastened to a formed reflecting back plane, not shown.

The shape of the earthed reflecting plane provides a cavity behind the radiating elements, which largely determines the bandwidth of the antenna in operation and provides shielded distribution cavities which act as a screen for the distribution network (no stray microstrip radiation) and the microstrip - cable transition section, and allowing the microstrip network to be located on the rear side of the board, thus protecting it from radome effects. The distance of the ground plane from the microstrip lines is such that the microwave signals propagate in a microstrip transmission mode as opposed to a stripline transmission mode. This is true for the microstrip tracks passing between the cavity area to the microstrip track-cable transition area.

Figure 14:
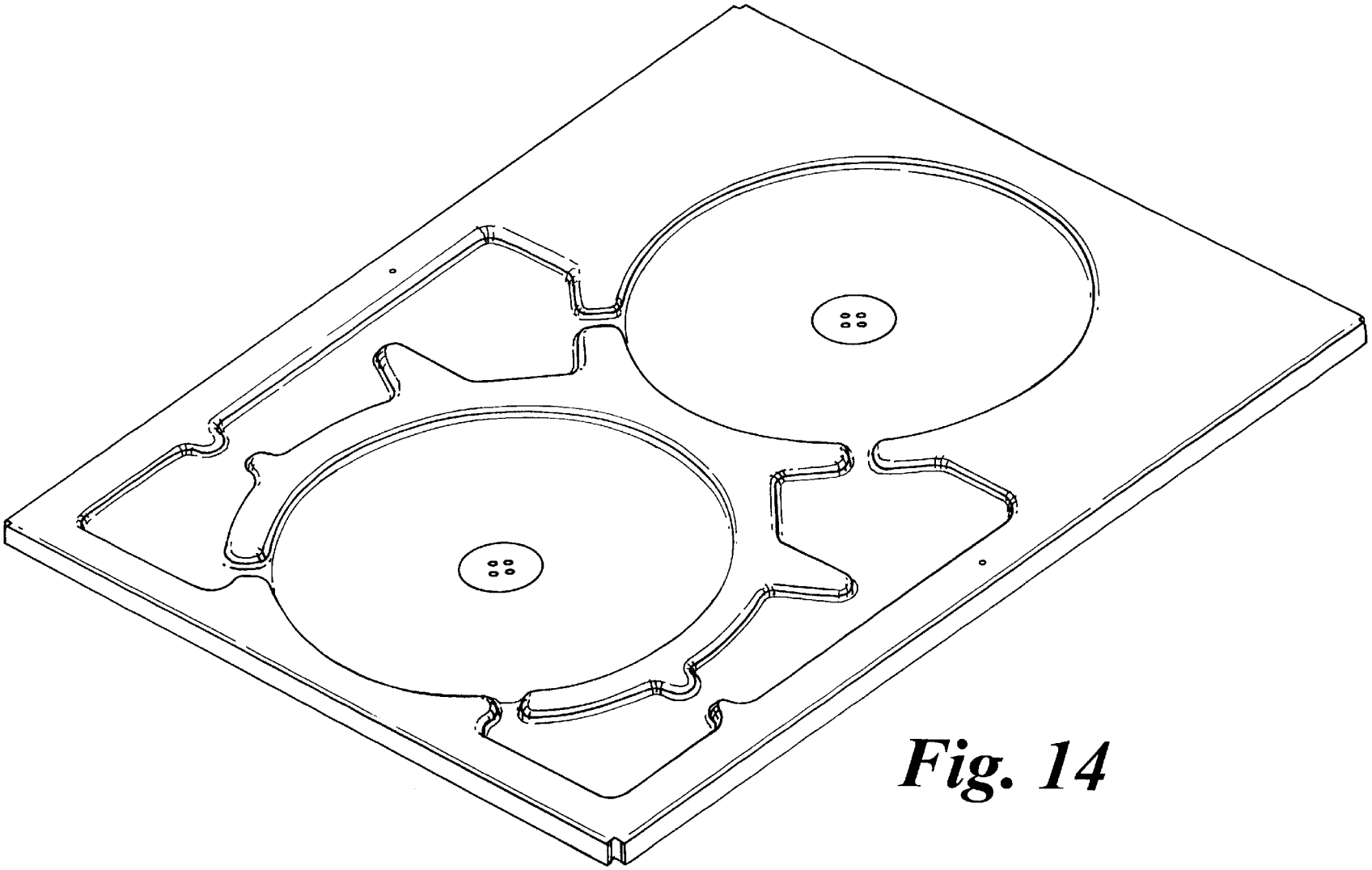
FIG. 14 shows in perspective view, a shaped ground plane, operable with the embodiment shown in FIG. 13.

This design therefore provides several advantages. FIG. 14 shows in perspective view, an example of a shaped ground plane, suitable for use with the antenna shown in FIG. 13.

Figure 15:
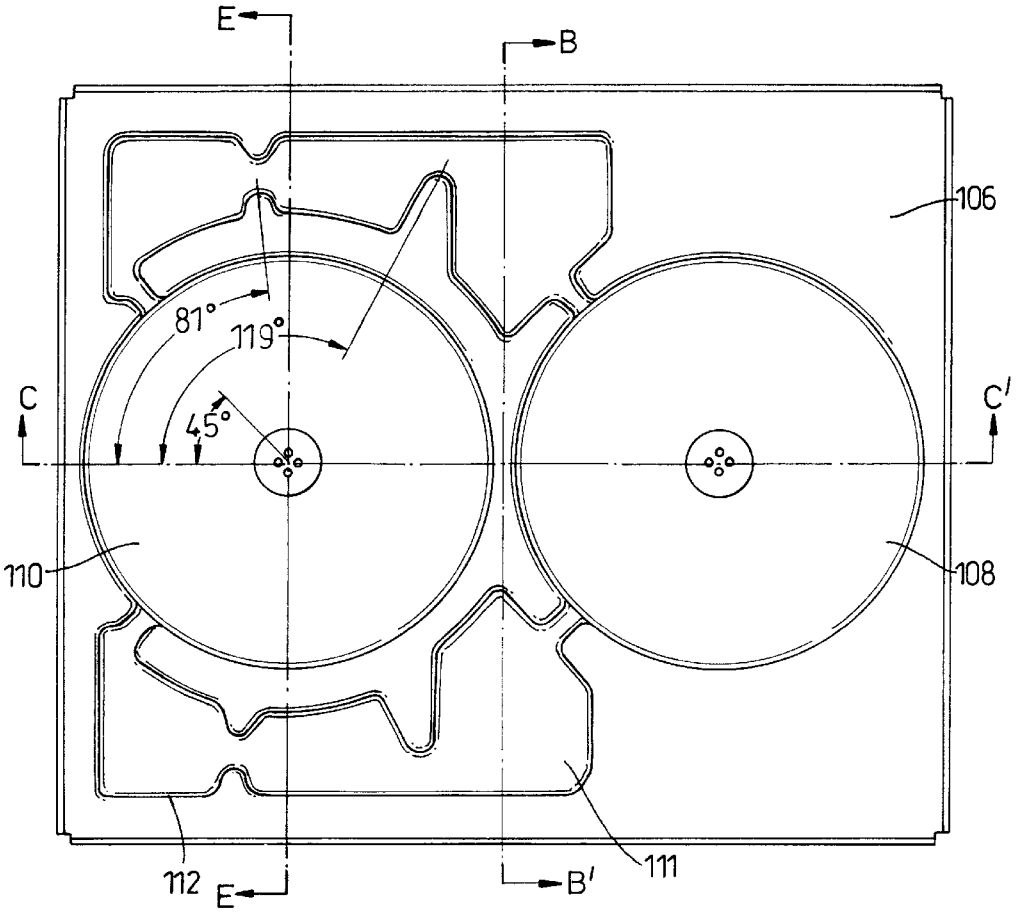
FIG. 15 is a plan view of the antenna shown in FIG. 14.
Figure 16:
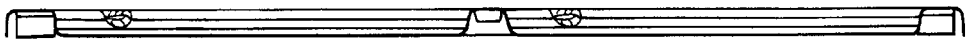
FIGS. 16, 17 and 18 are cross-sections through FIG. 15 along the lines C–C', B–B' and E–E', respectively.
Figure 17:
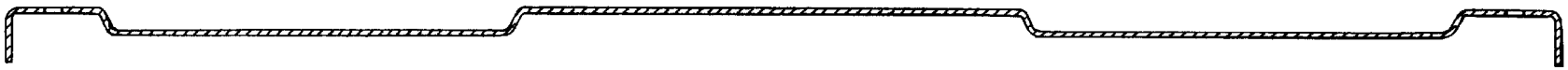
Figure 18:
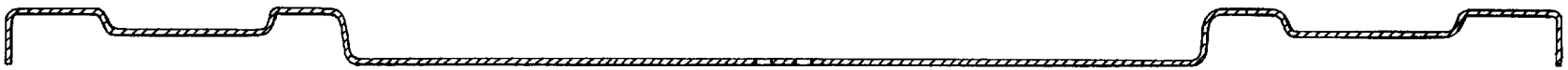

Referring now to FIG. 15, there is shown a plan view of the antenna back plane 106 as shown in FIG. 14, with FIGS. 16, 17 and 18 being cross-sections through FIG. 15 along the lines C–C', B–B' and E–E', respectively. Circular depressions 108 and 110 form the cavities behind patches 78 and 80. Radiussed edges 112 provide the transition from the reflecting portions to the areas which contact the dielectric. The back plane is pressed out of aluminium sheet having a thickness, typically, of about 1–2 mm. This thickness affects the radii of the cavities. As can be seen, the depressions provide convenient shielding areas for the microstrip feed networks. The depth of the cavity provides an increase in bandwidth, whilst the non-dished part offers mechanical support.

Figure 19:
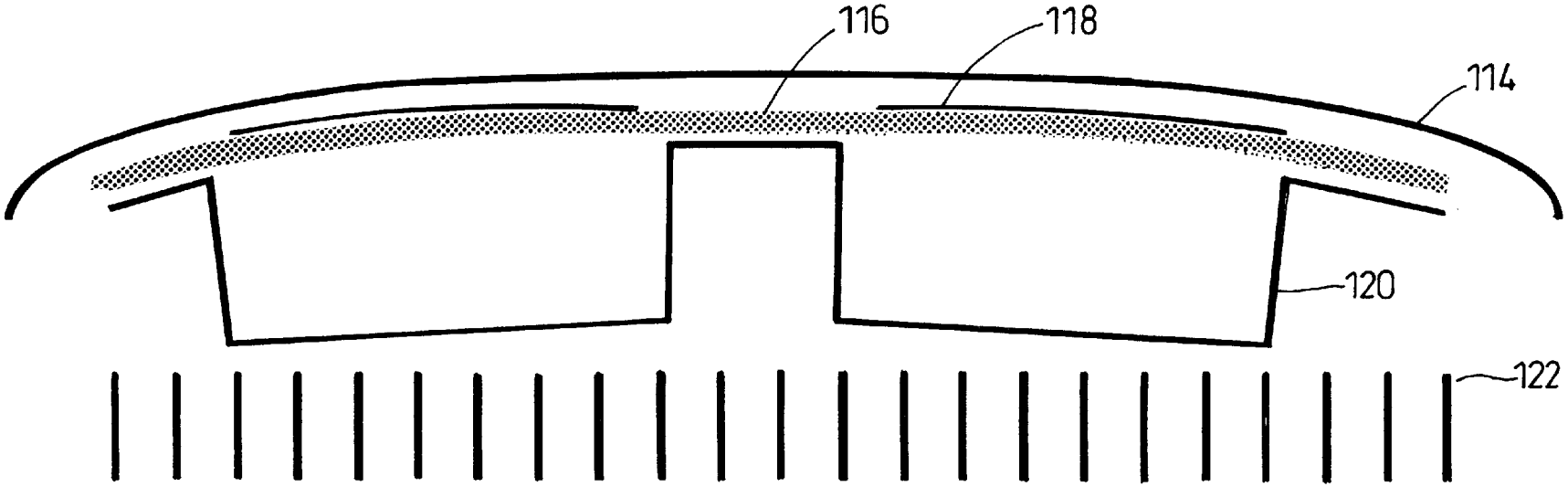
FIG. 19 shows the construction of an antenna assembly.

Referring now to FIG. 19, the overall construction of the antenna complete is shown. The antenna comprises a radome 114, a dielectric board 116 with a patch antenna 118 defined thereon and a shaped reflector ground plane 120. The ground plane is conveniently formed from aluminium to provide a lightweight structure, although materials such as zinc plated steel can also be employed. Optional heatsink fins 122 are shown. The back plate provides the reflecting ground plane for the cavities under the patch antennas, although in this Figure, the cavity depth is larger than would normally be the case for sub–2 Ghz signals. The back plate can be glued to the printed circuit board using an adhesive such as a TESA adhesive system (such as types 4965 or 4970. Similarly the radome can be glued to the radiating side of the printed circuit board. The formed aluminium back plane provides a back plane and a ground plane which offers environmental protection and seals against moisture ingress at the edges.

Microstrip losses and board control ($\in_r$ and tan $\partial$) are tolerable with the use of Getek (™) at both 900 and 1800 MHz. Getek board is an alternative to FR-4 board, and provides a board with a reasonable degree of control on dielectric constant spread. No foam is employed, which can retain water; the radome is strengthened by the dielectric and back plane. A variety of feed methods can be employed for the antenna elements to achieve both match and dual polarisation. The absence of foam spacers assists in increasing mechanical strength together with the shaped back plate. The shaped back plate also provides an integrated cable run and strain relief, dispensing with the need for cable connectors and clips.

What is claimed is:

1. A patch antenna comprising a dielectric substrate having a patch element on a first side in connection with a microstrip feed line therefor on a second side of the substrate and a reflector ground plane; wherein the microstrip feed line is connected through the substrate to the patch element, whereby the microstrip feed line lies parallel to the patch element, with the patch element acting as a ground with respect to the microstrip line.

2. A patch antenna according to claim 1 wherein the microstrip feed line has a separate ground plane disposed on the surface of the dielectric which supports the patch element.

3. A patch antenna according to claim 1 wherein the microstrip feed line has a separate ground plane disposed on the opposite surface of the dielectric to the surface which supports the patch element.

4. A patch antenna according to claim 2 wherein the ground plane is adapted to screen the microstrip feed.

5. A patch antenna according to claim 1 wherein the dielectric substrate is a printed circuit board material.

6. A patch antenna according to claim 1 wherein the dielectric substrate is a film.

7. A patch antenna according to claim 1 wherein the patch element is rectilinear or ellipsoidal in shape.

8. A patch antenna according to claim 1 wherein the patch element can have one or more feeds.

* * * * *